US011069192B2

(12) United States Patent
Czubak et al.

(10) Patent No.: US 11,069,192 B2
(45) Date of Patent: Jul. 20, 2021

(54) SYSTEM AND METHOD FOR A COMMUNITY GAME WITH HYBRID JACKPOT FUNDING

(71) Applicant: Novomatic AG, Gumpoldskirchen (AT)

(72) Inventors: Roman Czubak, Traiskirchen (AT); Anna Chyla, Cracow (PL); Anastasia Pekina, Village Yalgelevo (RU)

(73) Assignee: Novomatic AG, Gumpoldskirchen (AT)

( * ) Notice: Subject to any disclaimer, the term of this patent is extended or adjusted under 35 U.S.C. 154(b) by 0 days.

(21) Appl. No.: 16/458,081

(22) Filed: Jun. 30, 2019

(65) Prior Publication Data

US 2019/0325704 A1 Oct. 24, 2019

Related U.S. Application Data

(63) Continuation of application No. 14/605,490, filed on Jan. 26, 2015, now abandoned.

(60) Provisional application No. 61/934,926, filed on Feb. 3, 2014.

(51) Int. Cl.
*G07F 17/32* (2006.01)
*A63F 9/24* (2006.01)

(52) U.S. Cl.
CPC ..... *G07F 17/3258* (2013.01); *G07F 17/326* (2013.01); *G07F 17/3267* (2013.01); *G07F 17/3274* (2013.01); *A63F 9/24* (2013.01)

(58) Field of Classification Search
CPC ..... G07F 17/3274; G07F 17/326; G07F 17/3258; G07F 17/3267; A63F 9/24
See application file for complete search history.

(56) References Cited

U.S. PATENT DOCUMENTS 5,560,603 A * 10/1996 Seelig ..... G07F 17/32 273/143 R
5,959,276 A 9/1999 Iijima
6,033,307 A * 3/2000 Vancura ..... G07F 17/32 273/138.2
6,059,289 A 5/2000 Vancura
(Continued)

FOREIGN PATENT DOCUMENTS

EP 2110793 10/2000
EP 1139315 10/2001
WO WO2015113912 8/2015

OTHER PUBLICATIONS

Office Action for U.S. Appl. No. 14/605,490 dated Jun. 23, 2017; 11 pps.

(Continued)

*Primary Examiner* — William H McCulloch, Jr.
(74) *Attorney, Agent, or Firm* — RowanTree Law Group, PLLC; Magdalena M. Fincham

(57) ABSTRACT

A system and method for play of a community game in a casino establishment or on a network with general purpose computing devices for offering at least two players an opportunity to work cooperatively to achieve a community jackpot. The community jackpot may be awarded based on the outcome of a base game, or an outcome on a sub-game or a bonus game that involves a sequence of movements among the players. A system and method for providing hybrid jackpot funding technique is also described in which alternating funding schemes are used to fund the community jackpot and at least one other game jackpot simultaneously.

19 Claims, 14 Drawing Sheets

(56) References Cited

U.S. PATENT DOCUMENTS

| | | | | |
|---|---|---|---|---|
| 6,206,782 | B1 | 3/2001 | Walker et al. | |
| 6,210,275 | B1 | 4/2001 | Olsen | |
| 6,361,441 | B1 | 3/2002 | Walker et al. | |
| 6,648,759 | B2 | 11/2003 | Vancura | |
| 6,749,504 | B2 | 6/2004 | Hughs-Baird | |
| 8,253,665 | B2 | 7/2012 | Nakatsukasa | |
| 8,251,803 | B2 | 8/2012 | Nelson | |
| 8,523,665 | B2 * | 9/2013 | Baerlocher | G07F 17/3244 463/27 |
| 8,734,234 | B1 | 5/2014 | Guase | |
| 8,747,219 | B2 | 6/2014 | Wright | |
| 8,758,120 | B2 | 6/2014 | Wright | |
| 9,318,002 | B2 | 4/2016 | Caputo | |
| 9,367,994 | B2 | 6/2016 | Guase | |
| 9,547,956 | B1 | 1/2017 | Polyakov | |
| 9,595,162 | B2 | 3/2017 | Wright | |
| 10,867,478 | B2 * | 12/2020 | Hendricks | G07F 17/3267 |
| 2004/0235552 | A1 | 11/2004 | Gauselmann | |
| 2006/0135243 | A1 | 6/2006 | Englman et al. | |
| 2006/0166735 | A1 * | 7/2006 | Steil | G07F 17/3223 463/27 |
| 2007/0281784 | A1 | 12/2007 | Seelig et al. | |
| 2007/0298856 | A1 | 12/2007 | Gilmore | |
| 2008/0076519 | A1 | 3/2008 | Chim | |
| 2009/0061999 | A1 | 3/2009 | Popovich | |
| 2009/0124320 | A1 | 5/2009 | DeWaal | |
| 2010/0069143 | A1 * | 3/2010 | Tam | G07F 17/3274 463/25 |
| 2010/0087256 | A1 | 4/2010 | Frattiner et al. | |
| 2010/0124979 | A1 * | 5/2010 | Acres | G07F 17/32 463/20 |
| 2010/0124987 | A1 * | 5/2010 | Parham | G07F 17/3258 463/26 |
| 2011/0070940 | A1 * | 3/2011 | Jaffe | G07F 17/3211 463/20 |
| 2011/0092271 | A1 * | 4/2011 | Nguyen | G07F 17/3211 463/25 |
| 2013/0053217 | A1 | 2/2013 | Yount | |
| 2013/0084950 | A1 | 4/2013 | Olsen | |
| 2013/0217477 | A1 | 8/2013 | Wright | |
| 2013/0217505 | A1 | 8/2013 | Wright | |
| 2014/0031111 | A1 | 3/2014 | Bennett et al. | |
| 2014/0148230 | A1 | 5/2014 | Guase | |
| 2014/0243065 | A1 | 8/2014 | Wright | |
| 2014/0364234 | A1 * | 12/2014 | Smith | G07F 17/3272 463/37 |
| 2015/0080108 | A1 | 3/2015 | Decasa, Jr. | |
| 2015/0154831 | A1 | 3/2015 | Amone | |
| 2015/0221175 | A1 | 8/2015 | Czubak | |
| 2015/0356824 | A1 | 12/2015 | Aoki | |
| 2016/0171827 | A1 | 6/2016 | Washington | |
| 2016/0171835 | A1 | 6/2016 | Washington | |
| 2016/0292960 | A1 | 10/2016 | Guase | |

OTHER PUBLICATIONS

Final Office Action for U.S. Appl. No. 14/605,490 dated Oct. 26, 2017; 17 pps.

Office Action for U.S. Appl. No. 14/605,490 dated Apr. 19, 2018; 16 pps.

Final Office Action for U.S. Appl. No. 14/605,490 dated Nov. 2, 2018; 15 pps.

Office Action for U.S. Appl. No. 14/605,490 dated Mar. 27, 2019; 17 pps.

* cited by examiner

SYSTEM AND METHOD FOR A COMMUNITY GAME WITH HYBRID JACKPOT FUNDING

RELATED APPLICATION INFORMATION

This application claims priority benefit from U.S. Provisional Patent Application Ser. No. 61/934,926, filed on Feb. 3, 2014, the entirety of which is incorporated by reference in the present application.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Electronic gaming machines ("EGMs") offer a variety of games such as slot games, video poker games, roulette games, keno games and other types of wagering games that are commonly deployed at a casino for use by players. Play on the EGMs typically requires the player to place a wager on the outcome of the game. The games are programmed with a predefined set of outcomes including one or more winning outcomes and one or more losing outcomes. The player is awarded for a winning outcome and receives no award for a losing outcome.

Historically, the simple format of game play with a predefined set of outcomes has been appealing to players even though there are typically more losing outcomes than winning outcomes. However, game designers, players and operators of games are always striving to find appealing features and game functionality that will generate player excitement and increase, or at least maintain the interest of the player. Special awards, multipliers, bonus games and bonus features have become more and more popular in recent years as EGMs have grown more sophisticated, and players enjoy extending play with exciting new features and functionality.

The present invention defines a system and method that adds excitement and a new form of entertainment to the play of wagering games. It does so by offering a fun and captivating game feature which permits a group of players to work together as a community to win one or more community jackpots. The feature may be implemented in any game. Like other games played on an EGM, the player places an initial wager to play. A random outcome is generated based on a random number received from a random number generator ("RNG") and that outcome is displayed on the EGM display to the player. The invention may be implemented in a base game, a sub-game, a bonus or free spin game after a trigger in the base game, or in any combination where the game displays the community game play sequence. If the group of players, working together, is successful in achieving a set of game play objectives, each player in the group is awarded a portion of the community prize. If any one player does not continue to play, game play is ended and none of the players in the group is awarded a prize. The prize is a community jackpot, which is funded by wagers on EGMs played by the group of players, and may be in the form of a progressive jackpot, a mystery jackpot, a fixed jackpot or any other kind of award.

The community jackpot, along with other jackpots available during play of the EGMs, is funded by wagers on the EGMs. A hybrid jackpot funding technique is also described in which alternating funding schemes are used to fund the community jackpot and at least one other game jackpot simultaneously. In the first scheme, the timing of which is after a community jackpot has been awarded and until a base level of funding for the community jackpot has been reached, the funding allocation is increased to the community jackpot and decreased to the other jackpot(s). In the second scheme, the timing of which is after the community jackpot has been reached and before it is won, the funding allocation is decreased to the community jackpot and is increased to the other jackpot(s). In that way, the time is reduced to get the community jackpot up to the base level and available to be won by players.

The system and method are offered on electronic gaming machines such as slot machines and video poker machines, but may also be deployed on other devices such as on a general purpose computing device or mobile telephone in stand-alone form or connected to a network, such as the internet

BRIEF DESCRIPTION OF THE DRAWINGS

For a better understanding of the present invention, and to show more clearly how it functions, reference will now be made, by way of example, to the accompanying drawings. The drawings show embodiments of the present invention in which.

DETAILED DESCRIPTION OF THE INVENTION

Figure 1:
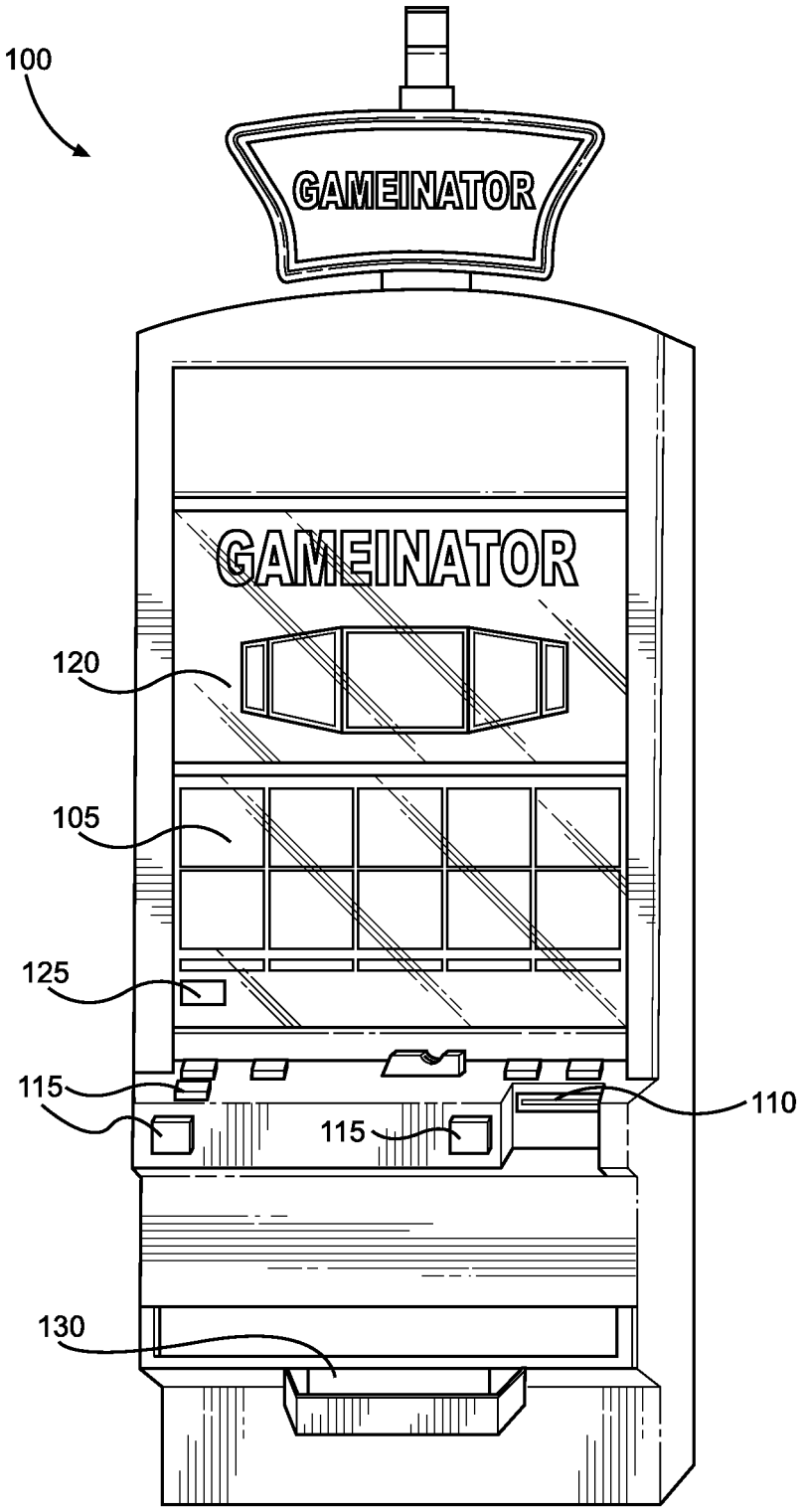
FIG. 1 Prior Art
FIG. 1 shows a prior art electronic gaming machine for playing a game.

The present invention will now be described more fully with reference to the accompanying drawings. It should be understood that the invention may be embodied in many different forms and should not be construed as limited to the embodiments set forth herein. Throughout FIGS. 1-5, like elements of the invention are referred to by the same reference numerals for consistency purposes.

FIG. 1 shows an electronic gaming machine ("EGM") 100 with a number of components. A primary display 105 is used to show game play and resulting outcomes, and may be in the form of a video display (shown), or alternatively, physical reels. Touch screen displays are included on most EGMs and provide a flexible interface for operation of EGM 100, including displaying symbols during game play. Other components include a bill validator (see FIG. 2A) housed inside EGM 100 into which bills may be inserted through bill slot 110. Buttons 115 on the exterior of EGM 100 are used to initiate and control EGM operations in conjunction with touch screen display 105 by the player. EGMs may further include a secondary display 120 for displaying other game functions including bonus screens. Either of primary display 105 or secondary display 120 may be used to show information to the player such as game play sequences, pay tables, messages, advertising, entertainment screens or other types of information. One or more meters 125 on display 105 are used for tracking credits available for play, amount won on a particular play, number of coins bet and other amounts. Meters 125 are typically positioned near the bottom of screen 105. EGM 100 may also accept coins. In those cases, a coin tray 130 at the bottom of EGM 100 is used to catch coins as they are dispensed to a player.

It is common for EGM 100 to include ticket-in, ticket-out ("TITO") capabilities that require a ticket reader and ticket printer housed inside of EGM 100 for accepting bar coded credits printed on a ticket through slot 110 and for which the value of the credits is displayed on meters 125 upon a ticket being inserted.

Figure 2A:
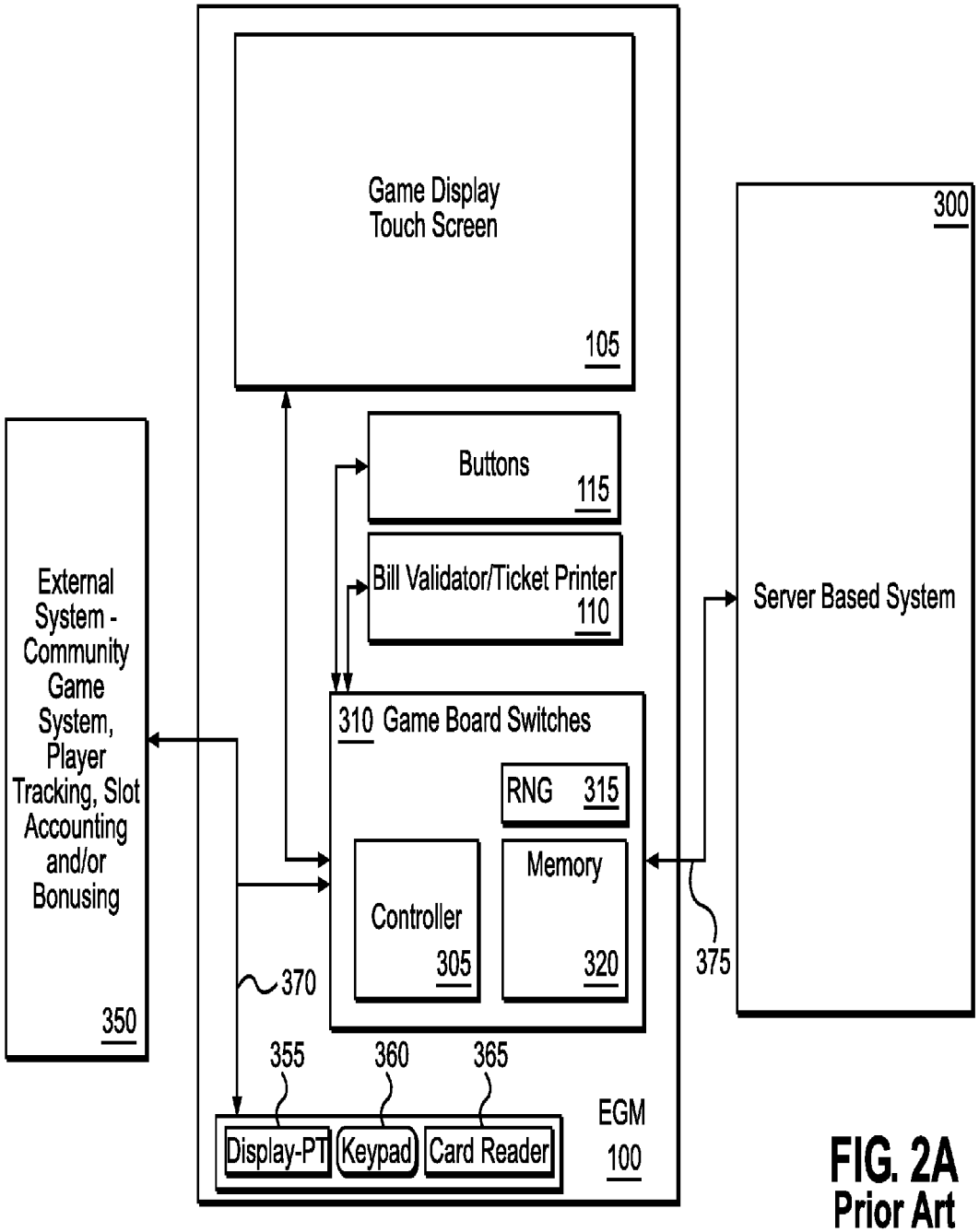
FIG. 2A Prior Art
FIG. 2A shows a prior electronic gaming machine for playing a game and connected to a network controlled by a server based system.

FIG. 2A is a block diagram of EGM 100 connected to a server based system 300 and showing certain internal components of EGM 100. All operational functions of EGM 100 are controlled by a controller 305 such as a microprocessor housed inside EGM 100 that is resident on a game board 310. The controller executes instructions that include operation of a random number generator 315 ("RNG") that is usually implemented in software and stored in a memory 320. The internal components of EGM 100 are well known to those of ordinary skill in the art. Game outcomes are determined based on the results corresponding to the numbers selected by RNG 315. A bill acceptor/validator 110 also has ticket printing capabilities. Bill validator 110 accepts currency in the form of bills or tickets from a player and adds credit to meter 125 on EGM 100.

An external system 350 such as a community game controller, a player tracking system, a slot accounting system or a bonusing system may also be connected to EGM 100. These types of systems are typically connected to EGM 100 either through a separate interface board (not shown) or directly integrated with the components of EGM 100 including but not limited to game board 310. A player tracking system may also include other components installed on EGM 100 such as a player tracking display 355, a keypad 360 and a card reader 365. These components allow for direct interaction between external system 350 and the player at EGM 100 to receive information from the player on the game buttons or other inputs, keypad 360 or through information on a card inserted into card reader 365, and to display information to the player on display 355. A network is established between external system 350 and EGM 100 by network connection 370. The network may be connected to all EGMs 100 in a casino or any smaller subset of EGMs 100.

Server based system 300 is also connected to EGMs 100 by a network connection 375 which may be a separate connection or on a connection to the same network as external system 350. Server based system 300 may have one or more individual servers tasked with different functions such as communicating with a player at EGM 100 to fulfill requests, delivering services such as television shows or other content, or a host of other information.

In FIG. 2A, EGM 100 is shown as a casino gaming device of the type depicted in FIG. 1. It will be understood that the type of network 370, 375 over which data is communicated can be one of several different types of networks. These networks include a Local Area Network (LAN), Wide Area Network (WAN), an intranet or the Internet. Other proprietary networks could also be used without departing from the principles of the invention. This would include such networks as a Windows network or an Ethernet network.

Figure 2B:
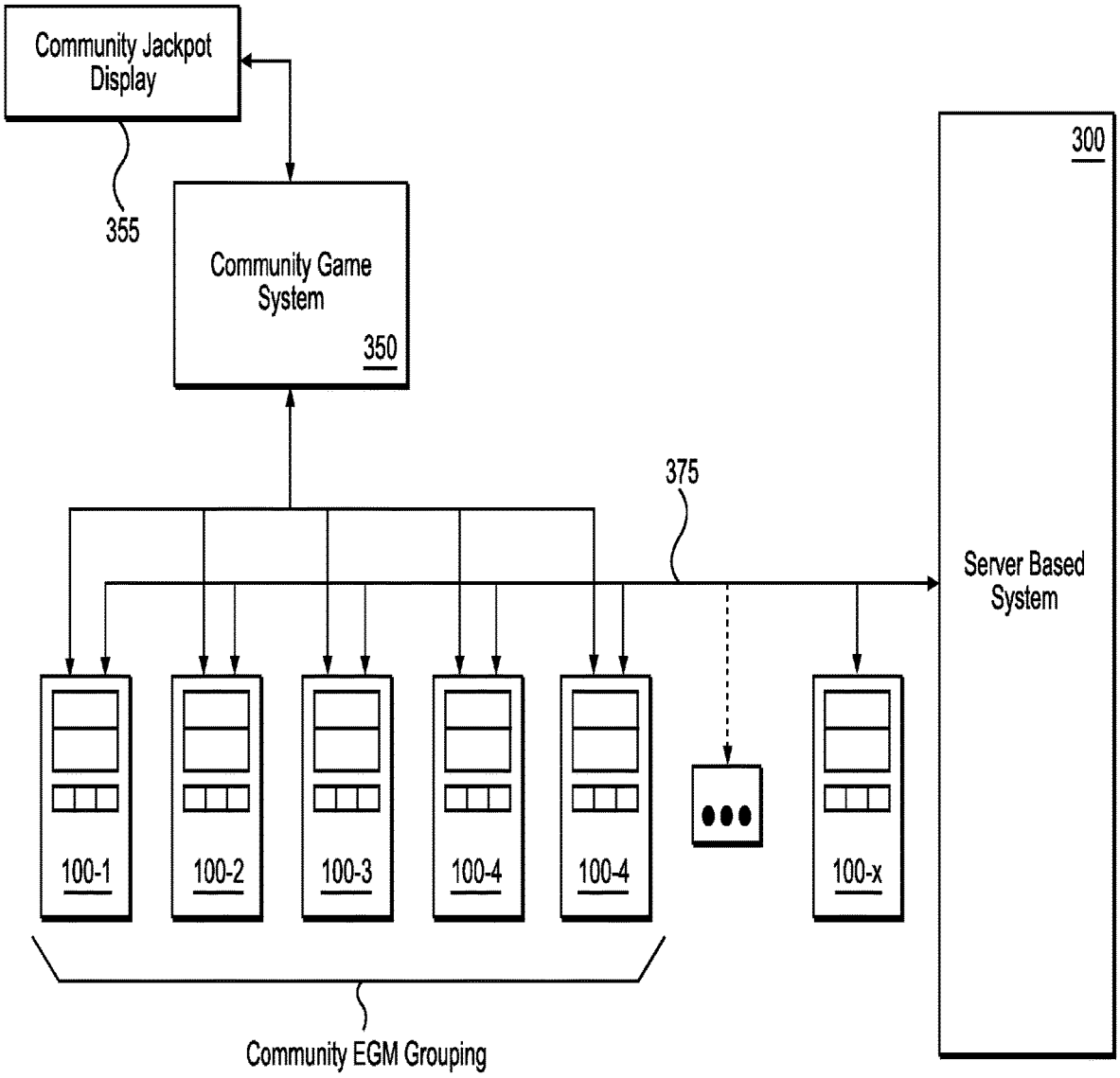
FIG. 2B Prior Art
FIG. 2B shows a group of electronic gaming machines, including a grouping of EGMs for playing a community game, on a network connected to a server based system and an external system.

FIG. 2B is a block diagram showing a group of EGMs 100 1-*x* on a network connection 375 between server based system 300 and each of EGMs 100 1-*x*. It should be understood that the network may be set up with any number of EGMs that may number into the thousands of machines. Each of EGMs 100 1-*x* is also connected to external system 350 that may be a player tracking, slot accounting, bonusing or other type of system. Information is communicated between EGMs 100 and server based system 300. A group of EGMs are networked together with community game system 350 on which the community game operates. A community jackpot display 355 may also be included to display actions on the community game being played among the community EGM grouping.

Figure 2C:
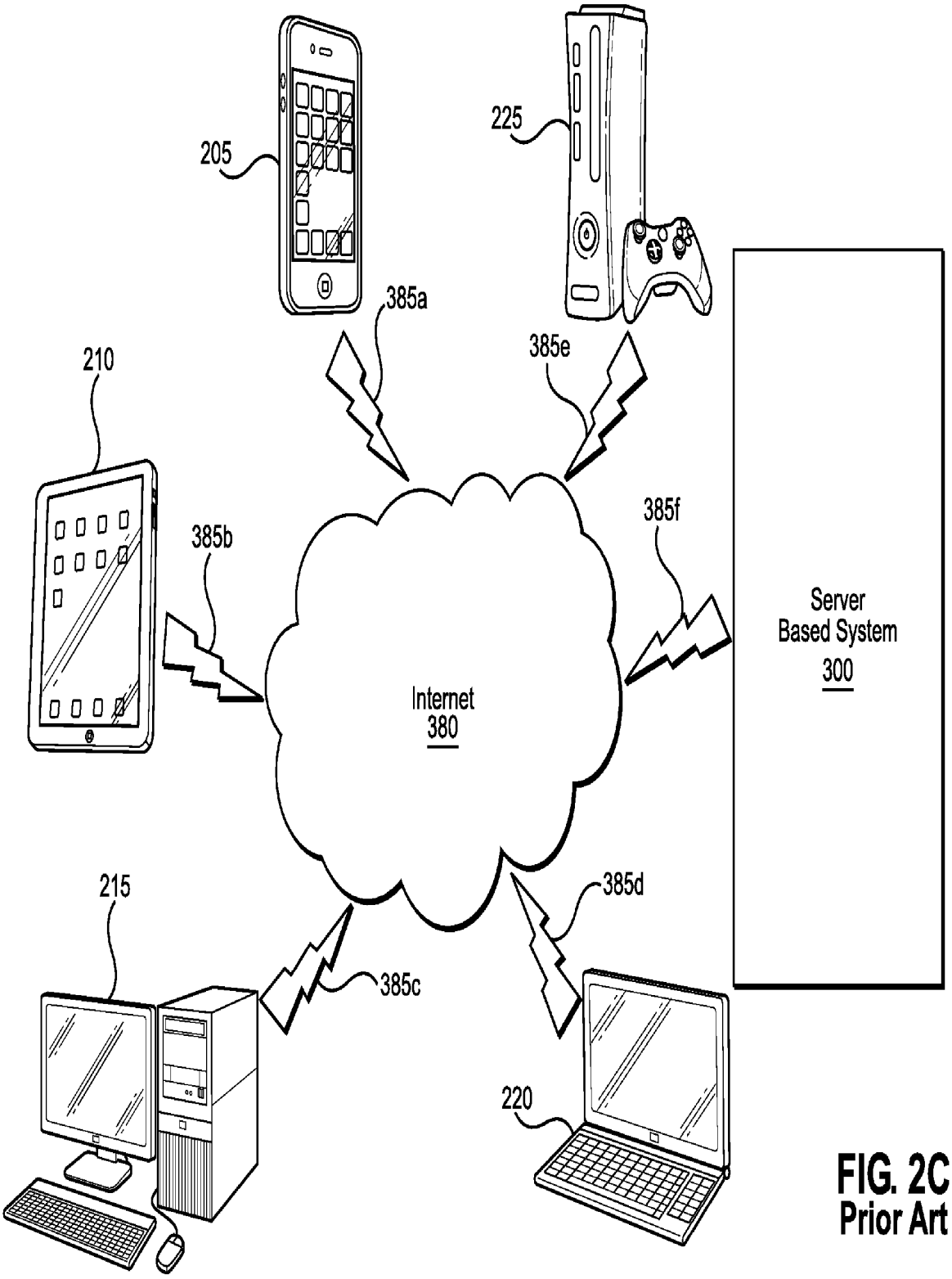
FIG. 2C Prior Art
FIG. 2C shows computing devices for playing a game, the devices optionally adapted to be on a network connected to a server based system.

FIG. 2C shows a number of general purpose computing devices which may be used to play a game, in particular it is shown: a smartphone 205 which may be an Apple iPhone 4S® as pictured, or any other mobile phone type device, a tablet computer 210 which may be an Apple iPad 3® as pictured, or any other tablet computing device, a desktop computer 215, a laptop computer 220, and a home video gaming device 225. Other types of network connected devices could also be used to play games including portable video gaming devices, or an internet connected television with a browser or app capabilities. Any of these devices is capable of playing a game, including a wagering game, through an app loaded onto the device or through a website accessible using a browser on the device. In the case of the networked game, payment may be made by credit card, Paypal® or another payment service. The RNG is run securely on server based system 300 (See FIG. 2A) and then delivers the outcomes over the internet to be displayed on the general purpose computing device. It should also be understood that the game may be played for fun without a wager, or using promotional or "fun" credits that do not have monetary value. FIG. 2C further shows a server based system 300 connected to a network with multiple computing devices for playing games.

It should be understood that the network shown in FIG. 2C operates in a manner similar to the network of FIG. 2B, except that the computing devices on the network of FIG. 2C are preferably connected over the internet 380 with each device 205-225 connected over a secure connection 385*a-e* to server based system 300 which connects to the internet over network connection 385*f*. Payments can be made securely over internet 380 using connections 385*a-e*, and then delivered to an operator over connection 385*f*. Similarly, the game is executed on server based system 300 using a secure RNG with the outcomes being delivered to the individual devices 205-225 over internet 380. It should be understood that any one or more of the general purpose computing devices—smartphone 205, tablet computer 210, desktop computer 215, laptop computer 220, or home video gaming system 225 could be placed on a network connected to server based system 300 and used to deliver a game with one or more community jackpots. For purposes of this specification, reference to one or more EGMs 100 in an environment using a limited access intranet of the type typically found in a casino would also apply to one or more general purpose computing devices with a secure connection to a server over the internet and not involving a physical casino property at all, and which may or may not require a wager or payment to play. Alternatively, the game software or a portion of it may be resident and executed on each device 205-225. Wagers by players and payments to players may be made using accounts set up with an operator of a website on which the games are run.

For purposes of describing the operation and game flow of the invention, reference will be made to an EGM 100 as shown in FIG. 1. However, it will be understood that the game may be similarly implemented for operation and play by a user on any type of electronic device with capabilities for game play including but not limited to those shown in FIGS. 2A-2E.

Figure 3A:
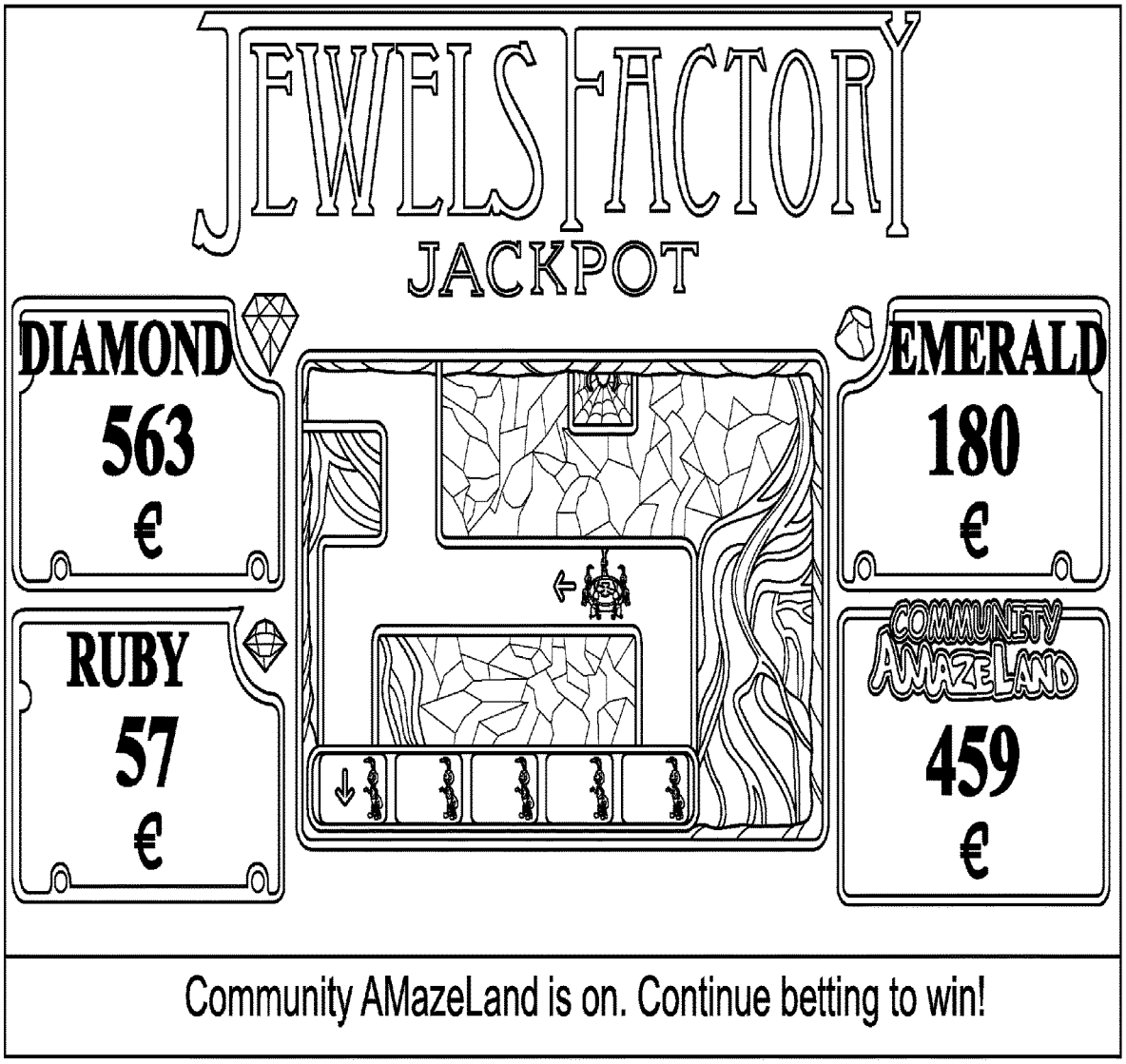
FIGS. 3A-H shows screen shots depicting an example of a sequence of play of the community game.

FIGS. 3A-H shows screenshots depicting an example of a sequence of play of the community game. In this example, FIG. 3A is a screenshot of the jackpot screen for a game known as "*Jewels Factory*," which includes four different progressive jackpots: (1) Diamond 405; (2) Emerald 410; (3) Ruby 415; and (4) Community AMazeLand 420. The first three jackpots 405. 410, 415 are typical tiered progressive jackpots while the fourth jackpot 420 is a community jackpot that is available to a group of players working together to achieve predefined objectives. At the time of the screenshot, a community game has been started after a group of players have entered the community phase of the game. The community phase may be the base game itself, a bonus game, a sub-bonus game or any other phase of a game that is played on the community grouping of EGMs. Once the community game is triggered, the players are informed that the "Community AMazeLand is on. Continue betting to win!" as can be seen in the comment line 425 at the bottom of the screenshot.

In the example shown, each of the players in the community is represented by an ant 430*a-e* on the screen. Each of the ants is shown in a chamber 435*a-e* with each player being assigned an ant 430*a-e* with a different colored vest to differentiate them, as can be seen for each of the ants in chambers 435*a-e* and corresponding to a particular ant moving cooperatively with the other participating ants in a maze 437.

Figure 3B:
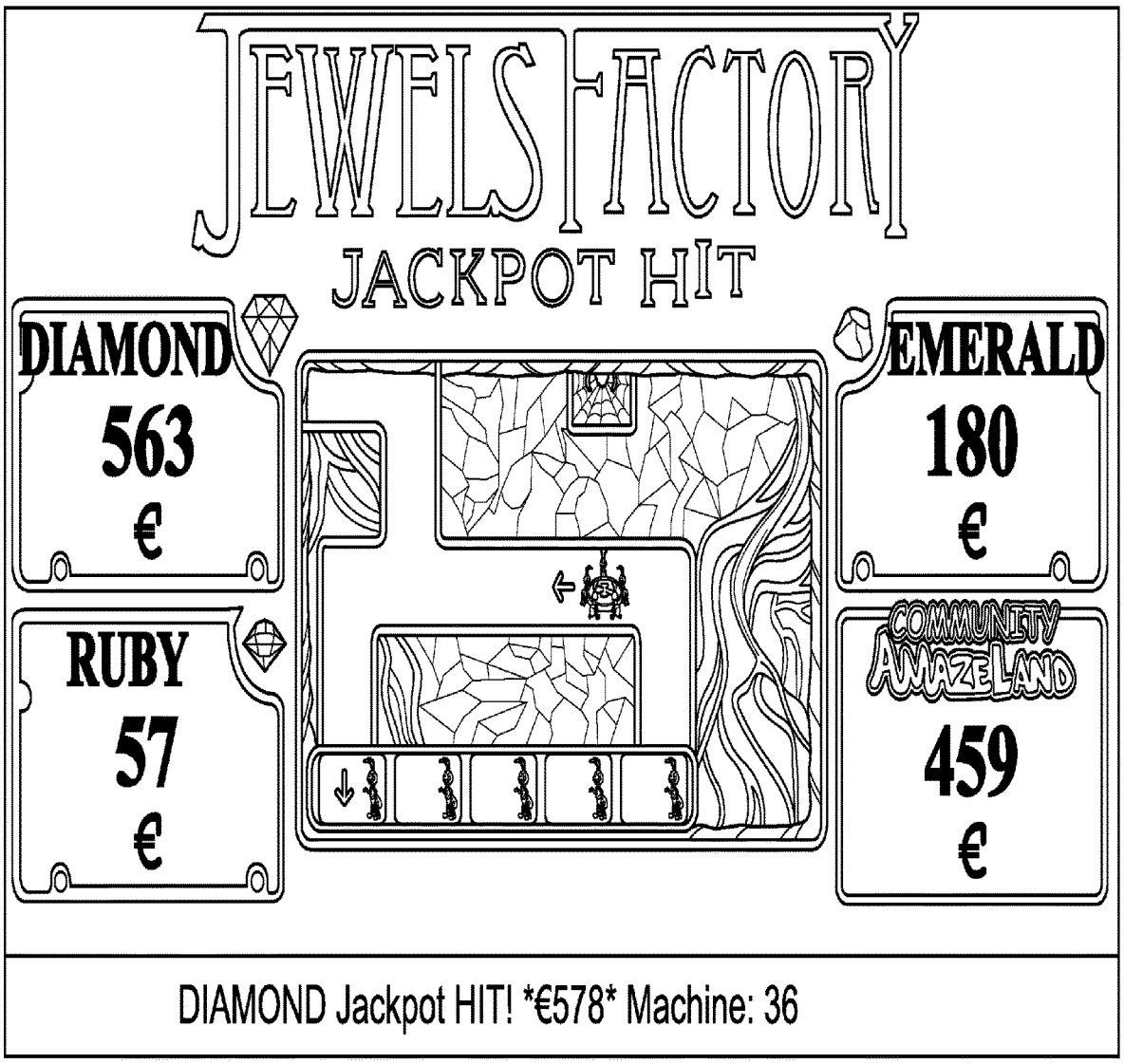

FIG. 3B is a screenshot after play of the community game has begun. During play, the players are working cooperatively to win the community jackpot 420, but they are also playing individually for the progressive jackpots 405, 410, 415. As can be seen in the screenshot of FIG. 3B, the player on machine 36 has hit the diamond jackpot and is awarded a prize of €578 as indicated by reference number 425 that now presents the comment to the player "Diamond Jackpot HIT! *€578* Machine: 36." Even after winning one of the progressive jackpots, the players in the community continue to play together for the community jackpot.

Figure 3C:
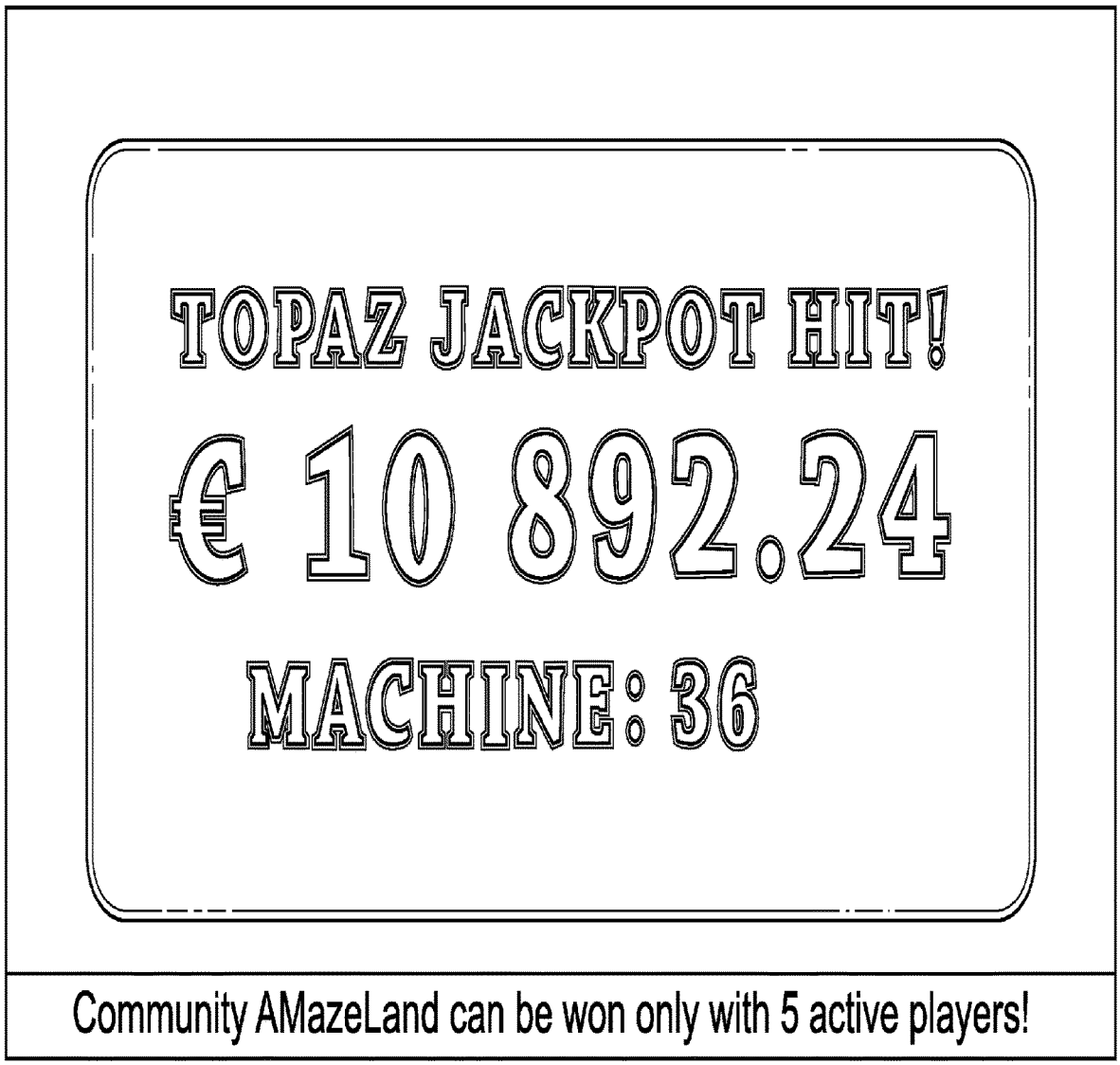

In addition to the multiple jackpots displayed in FIG. 3A, it's also possible to have mystery jackpots that are available for players to win. FIG. 3C shows a mystery jackpot known as the "Topaz" jackpot 440. In this case, comment line 425 indicates to the player at machine 36 that he has won €10,892.24 after hitting the Topaz jackpot. The community game continues to be played even after a mystery jackpot has been hit by one of the players in the community. Mystery jackpots are known in the art and are jackpots that are generated on a bonus system of the type shown and described with respect to FIG. 2A. Prior art mystery jackpot systems are disclosed, for example, in U.S. Pat. No. 8,523,665, which itself references a number of prior art patents and publications. The disclosures of U.S. Pat. No. 8,523,665 along with those other referenced patents and publications are all hereby incorporated by reference into the present case.

The community jackpot requires the cooperation of all players in the particular community. As can be seen in FIG. 3C, after an individual player has won the Topaz mystery jackpot, there is an informational message 425 indicating to the player that "Community AMazeLand can be won only with 5 active players!" If one of the community players drops out after winning a mystery or progressive jackpot, the community game is ended.

Figure 3D:
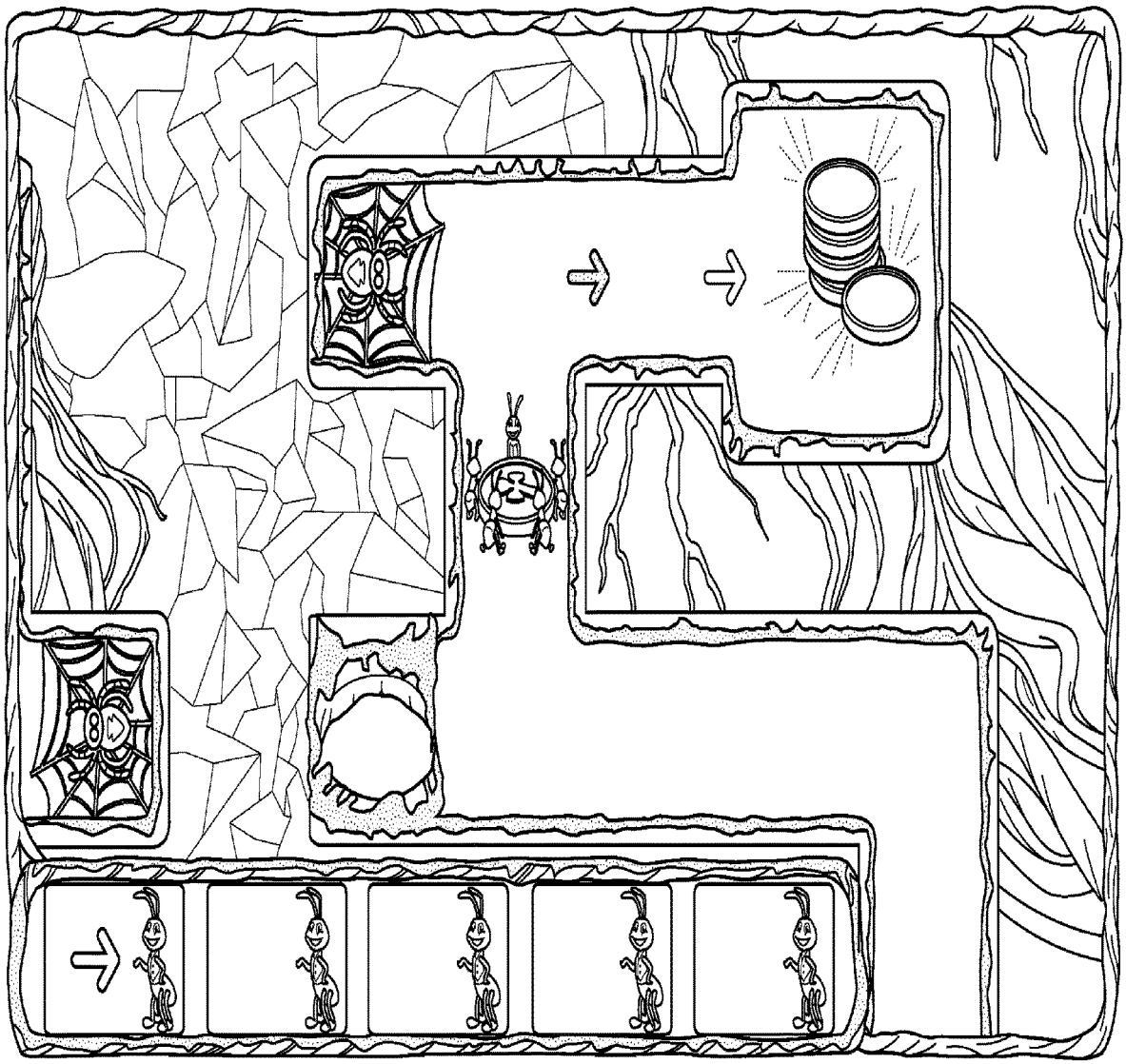

FIG. 3D is a screenshot of a game play screen for the community game. In this screenshot, a group of 5 ants 430*a-e* is working cooperatively, and is shown attempting to move a gold coin 445 to a treasure chamber 450. The five ants 430*a-e* are controlled by 5 different players on EGMs 100-1 through 100-5 playing cooperatively in a community game grouping as shown in FIG. 2B. If the group is successful, the players will split the community prize. Along the way, the group encounters hazards which may be in many different forms that try to block or otherwise present obstacles to the community from winning the community jackpot. In the screenshot of FIG. 3D, one example of an obstacle is a hole 455 and a second example of an obstacle is a spider 460.

Figure 3E:
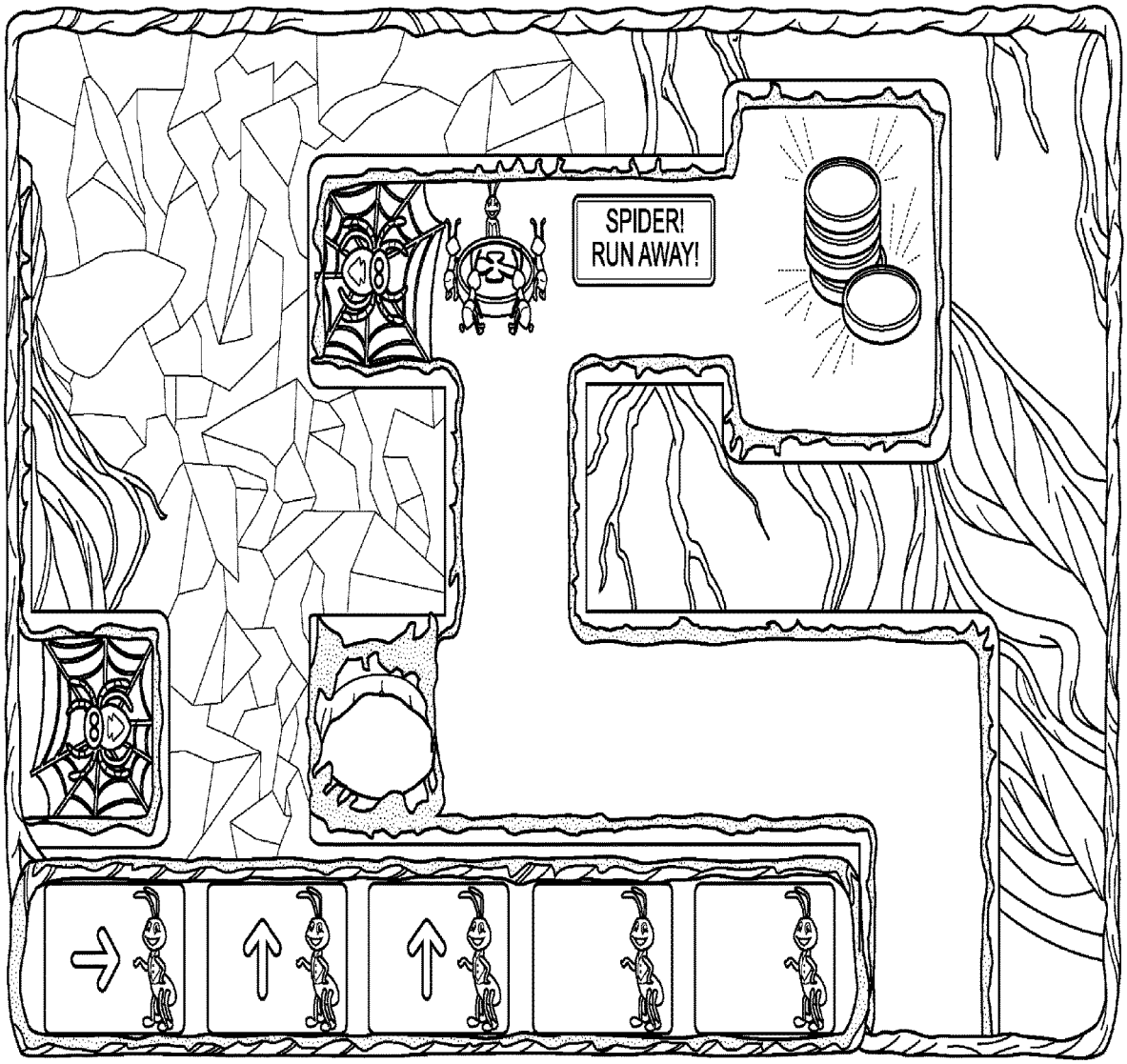

In the embodiment depicted in the screenshots of FIG. 3E, the movement of the ants in maze 437 is controlled among the five players at EGMs making up the community or group. Each game played on one of the 5 community EGMs draws one of 4 directions for the ants to move as indicated by the arrows (465*a-c*) that appear next to each ant 430*a-e* in the representative chamber 435*a-e* at the bottom of the screen as shown in FIG. 3E. It should be understood that for purposes of the example, the 4 directional arrows are "up," "down," "left," or "right." Other arrow types may also be used such as diagonal arrows or a "wild card" arrow that may be used by the player to move in any direction. A player with the "proper directional" arrow for the next move can use that arrow to move the ants collectively towards treasure chamber 450. If none of the players has the proper directional arrow available, ants 430*a-e* are forced to move backwards, or into the path of an obstacle such as spider 460 or hole 455. The arrows are provided to the player as they wager on each play. As the play continues, ants 430*a-e* may end up navigating maze 437 and successfully arriving at treasure chamber 450 with all of the gold coins, or they may be led to a hazard along the way such as spider 460 or hole 455. If ants 330*a-e* are forced to move to an obstacle, play of the game ends without winning a jackpot.

Figure 3F:
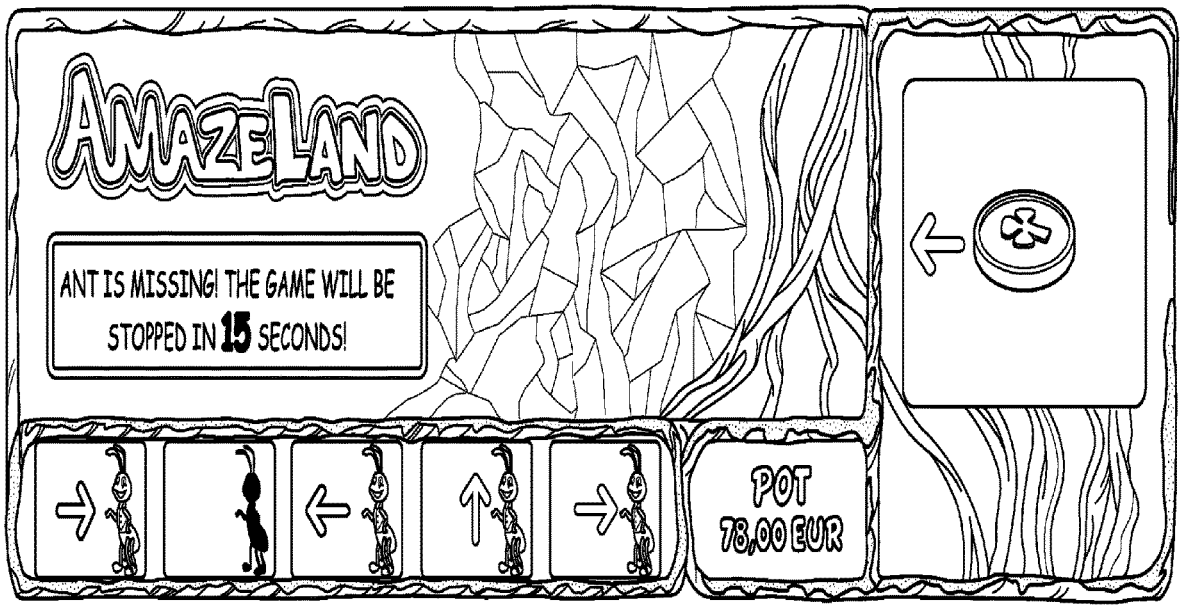
Figure 3G:
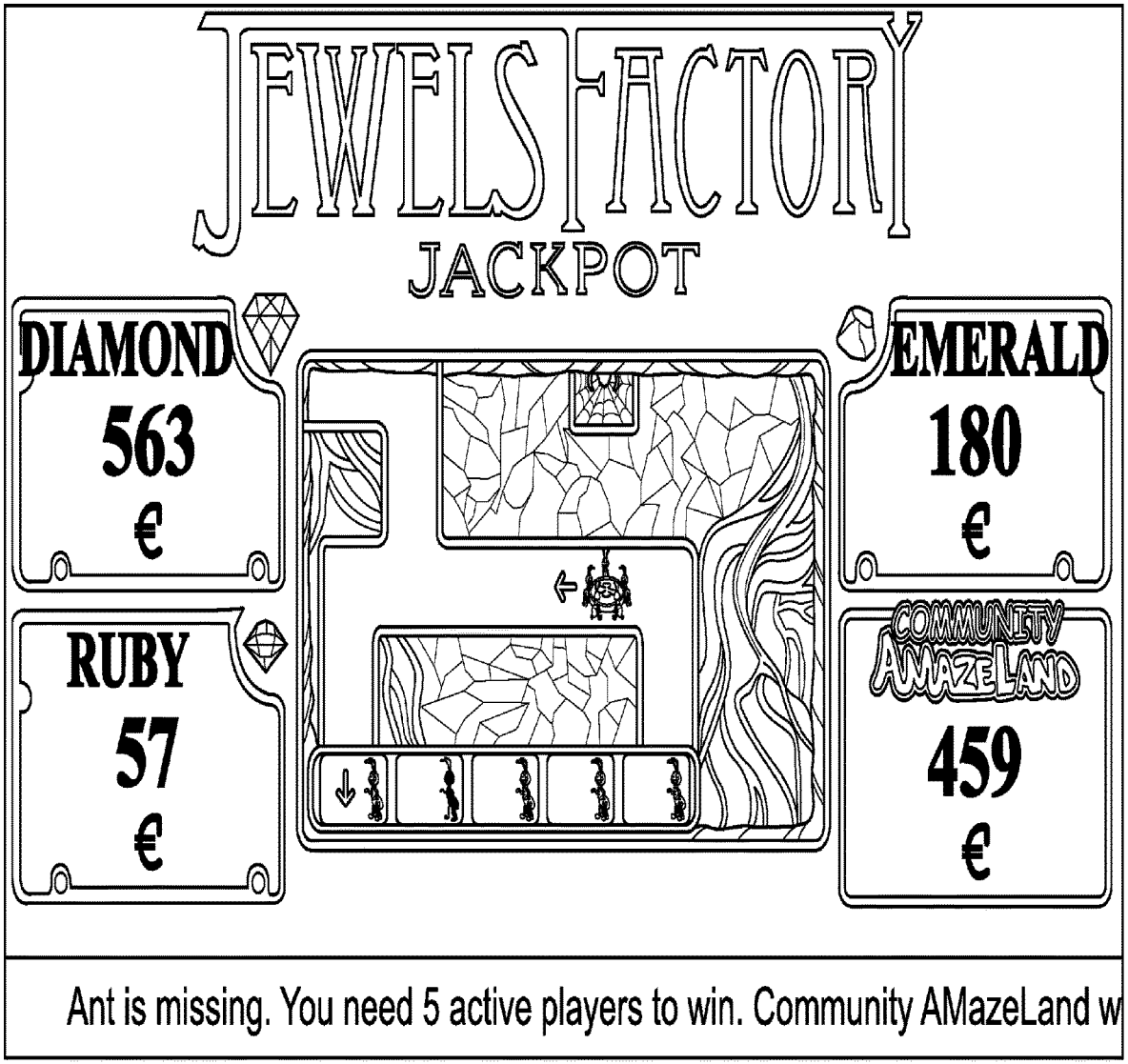

Visual information is continuously shown to the players about the community game and shows the activity and progress of the group of ants collectively, and the current directional arrow available to each individual ant in the chambers for the ants in comment box 425 at the bottom of the screen. FIG. 3F is a screenshot of an informational screen showing that the second ant from the left (chamber 435*b*) is in jeopardy of default because a wager has not been made. As can be seen, the message to all players in the group is that "Ant is missing! The game will be stopped in 15 seconds" unless a wager is placed by the player represented by that ant. In this embodiment, all players must continue to place wagers for community game play to continue, although the pace of wagering may differ between the players, provided a cumulative minimum wagering pace is complied with by all players. If one player among the group is inattentive or fails to continue to place wagers and play the game, the other players will encourage him to do so, particularly if the group is close to achieving the community jackpot. FIG. 3G is a screenshot of the game before or after the informational message showing the ant in chamber 435*b* that has failed to make a required wager.

Figure 3H:
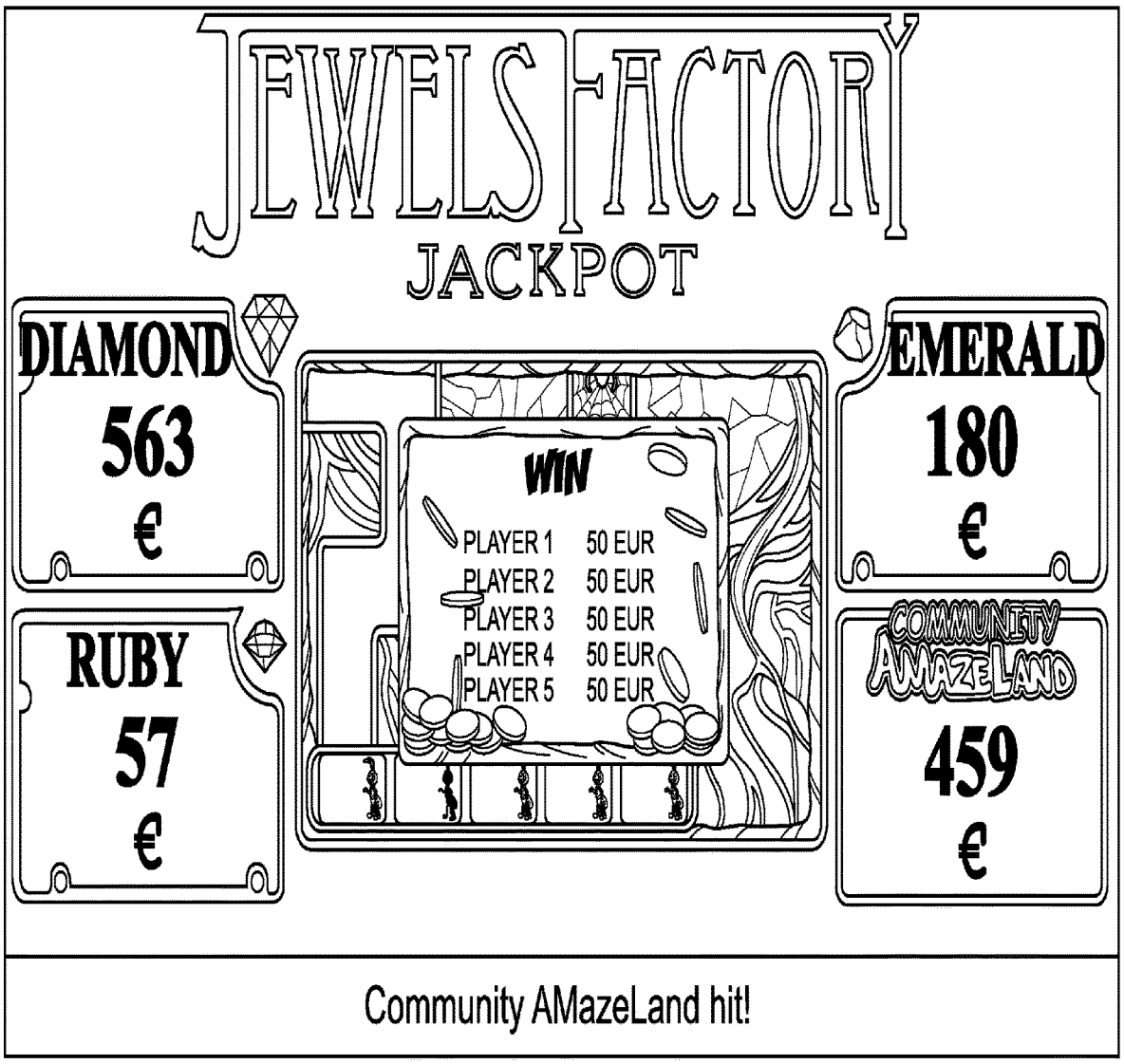

FIG. 3H is a "win screen" showing that that the group has successfully navigated the group of ants 430*a-e* into treasure chamber 450 and won the community jackpot. The message "Community AMazeLand hit!" 425 is shown to the players on the screens of their individual EGMs and the prize is divided among the group. It is possible to divide the prize equally or to allocate amounts relative to the amount wagered by each player during the community game.

It should be understood that in addition to showing the game play sequence on the screen of each individual EGM at which the players are positioned and wagering for play, a large community screen 355 (FIG. 2B) above the group of EGMs may also show the game play sequence so all of the players can see it as well as other patrons in the gaming establishment.

The game play has been represented with a group of ants navigating a maze. It should be understood that there is an infinite number of game themes and variations to the play sequence that may be used to embody the invention.

All of the jackpots for the game (e.g. Diamond, Emerald, Ruby, Community, Mystery, etc.) are funded simultaneously from an allocated portion of the wagers on the EGMs connected to the system. It is well known to fund two or more progressive (or fixed) jackpots by taking a percentage of each wager and allocating it to the available jackpots. For example, a set of tiered progressives may have a fixed percentage assigned to them for funding such as the top prize getting 3%, the second tier prize getting 2% and the third tiered prize getting 1%.

According to the present invention, a hybrid approach is used to fund the tiered prizes as well as the community prize at different times. For example, a portion of each of the amounts allocated for funding the tiered prizes—Diamond, Emerald and Ruby—is used to fund the community jackpot until it reaches its base level. Also, during the time until the base level for the community amount is reached, a hit on the community jackpot is not permitted. Therefore, in the example case presented above, one half of the funding stream for each of the tiered prizes—Diamond, Emerald and Ruby—or 1.5%, 1% and 0.5% respectively, goes to the community jackpot until it reaches a base level. At the same time and to get the community prize to the base level faster, a separate portion of the wager may also be allocated to the community jackpot. Then, once the community jackpot reaches the base level, the other funding streams are returned to the original amounts. This approach is referred to as a "hybrid" or "dynamic" funding system that allows the community jackpot to be available for play in a shortened time at the cost of a slowing in the growth rate of the funding of the other jackpots.

Alternatively, the contribution scheme may be defined for the standard funding of jackpots as follows for scheme A:

| | Contribution | Hidden contribution |
|---|---|---|
| Community level | c_contr | — |
| Mystery level 1 | contr1 | hcontr1 |
| Mystery level 2 | contr2 | hcontr2 |
| Mystery level 3 | contr3 | hcontr3 |

Based on the contributions from the above table and a pre-defined contribution division factor (CDF) parameter (e.g. 70%), a second set of contributions is calculated with a larger share of the total contribution going to fund the community jackpot e.g. by contributions and by a so called hidden contribution until it reaches the base level for a win. This funding scheme is a temporary scheme that is in effect until the community jackpot reaches the base level for scheme B:

| | Contribution | Hidden contribution |
|---|---|---|
| Community level | 30% c_contr | 70% (c_contr + contr1 + hcontr1 + contr2 + hcontr2 + contr3 + hcontr3) |
| Mystery level 1 | 30% contr1 | 30% hcontr1 |
| Mystery level 2 | 30% contr2 | 30% hcontr2 |
| Mystery level 3 | 30% contr3 | 30% hcontr3 |

In the case above using a CDF parameter of 70%, the mystery jackpot funding allocations are reduced by 30% each and the difference is allocated to the community jackpot or to a community hidden jackpot by community hidden contributions. Those two contributions schemes A and B are used alternately, depending on, for example, the value of the community hidden jackpot. It is possible that during the previous game, the community hidden jackpot did not reach the base level for a win—the so called community reset value. In that case, the missing amount is collected during the next game.

If the CDF parameter is 70% as shown above, the community reset value is €10, and the operator sets the contribution values as follows for scheme A:

| | Contribution | Hidden contribution |
|---|---|---|
| Community level | 1% | — |
| Mystery level 1 | 0.8% | 0.2% |
| Mystery level 2 | 0.5% | 0.2% |
| Mystery level 3 | 0.3% | 0.1% |

Then, the second set of contributions is calculated as follows for scheme B:

| | Contribution | Hidden contribution |
|---|---|---|
| Community level | 30% of 1% = 0.30% | 70% of (1% + 0.8% + 0.2% + 0.5% + 0.2% + 0.3% + 0.1%) = 2.17% |
| Mystery level 1 | 30% of 0.8% = 0.24% | 30% of 0.2% = 0.06% |
| Mystery level 2 | 30% of 0.5% = 0.15% | 30% of 0.2% = 0.06% |
| Mystery level 3 | 30% of 0.3% = 0.09% | 30% of 0.1% = 0.03% |

Figure 4:
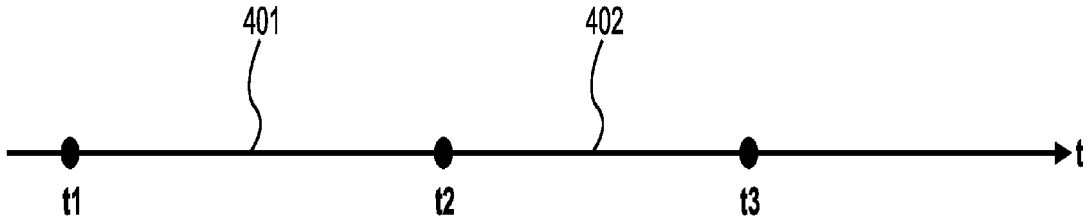
FIG. 4 is a time flow diagram showing the jackpot funding with at least two different funding schemes.

FIG. 4 shows a time flow diagram using an axis of time t. The time flow diagram shows how the jackpot funding is alternated back and forth between the two schemes A and B shown above. The usage of the respective scheme A or B depends on the level or value of the community hidden jackpot. In the example, the community game starts at a first time t1 and the community jackpot is set to the defined community reset value (e.g. €10). In parallel, the community hidden jackpot starts to grow. During a first time period 401, starting at the first time t1, the jackpots of all levels are allocated according to the scheme B table. So the community hidden jackpot grows fast and the other jackpots (e.g. community jackpot, mystery jackpot of levels 1 to 3) grow more slowly.

Then, when the community hidden jackpot reaches the predefined reset value of e.g. €10 at a second time t2, as shown in FIG. 4, the contribution scheme is switched to scheme A. So, at the second time t2 during which the contribution scheme B is used, the first time period 401 ends. During a second time period 402, starting with the second time t2, the contribution scheme A is used—i.e. all contributions to the jackpots return to defined standard values and the community hidden jackpot is frozen. The contribution scheme A continues until a third time t3, when the community game ends (e.g. the community jackpot is won). Then, for the next game, the community jackpot is set to the community reset value e.g. €10. This amount is taken from the community hidden jackpot and the contribution scheme is again switched to scheme B. The time flow as shown in FIG. 4 starts again at the first time t1 and the cycle repeats.

Further, if the community game is finished (e.g. a player leaves the community game or does not place a wager in time) during the first time period 401 before the community hidden jackpot reaches the community reset value of e.g. €10, then the deficient amount is collected during the next game. For example, if the community game is finished during the first time period 401 and the community hidden jackpot reaches a value of only €8, then the deficient €2 is added to the community reset value during the next community game. In the next cycle, the new community reset value for this particular community game is the community reset value of €10 plus €2 making it €12. This means, during the new game the time period 401 with contribution scheme B continues until the community reset value of, for example, €10 plus €2 is reached by the community hidden jackpot. If this new value (e.g. €12) is reached by the community hidden jackpot by the second time t2, then the contribution scheme is switched to scheme A, which is used during the second time period 402 until the community game is finished at the time t3.

Figure 5:
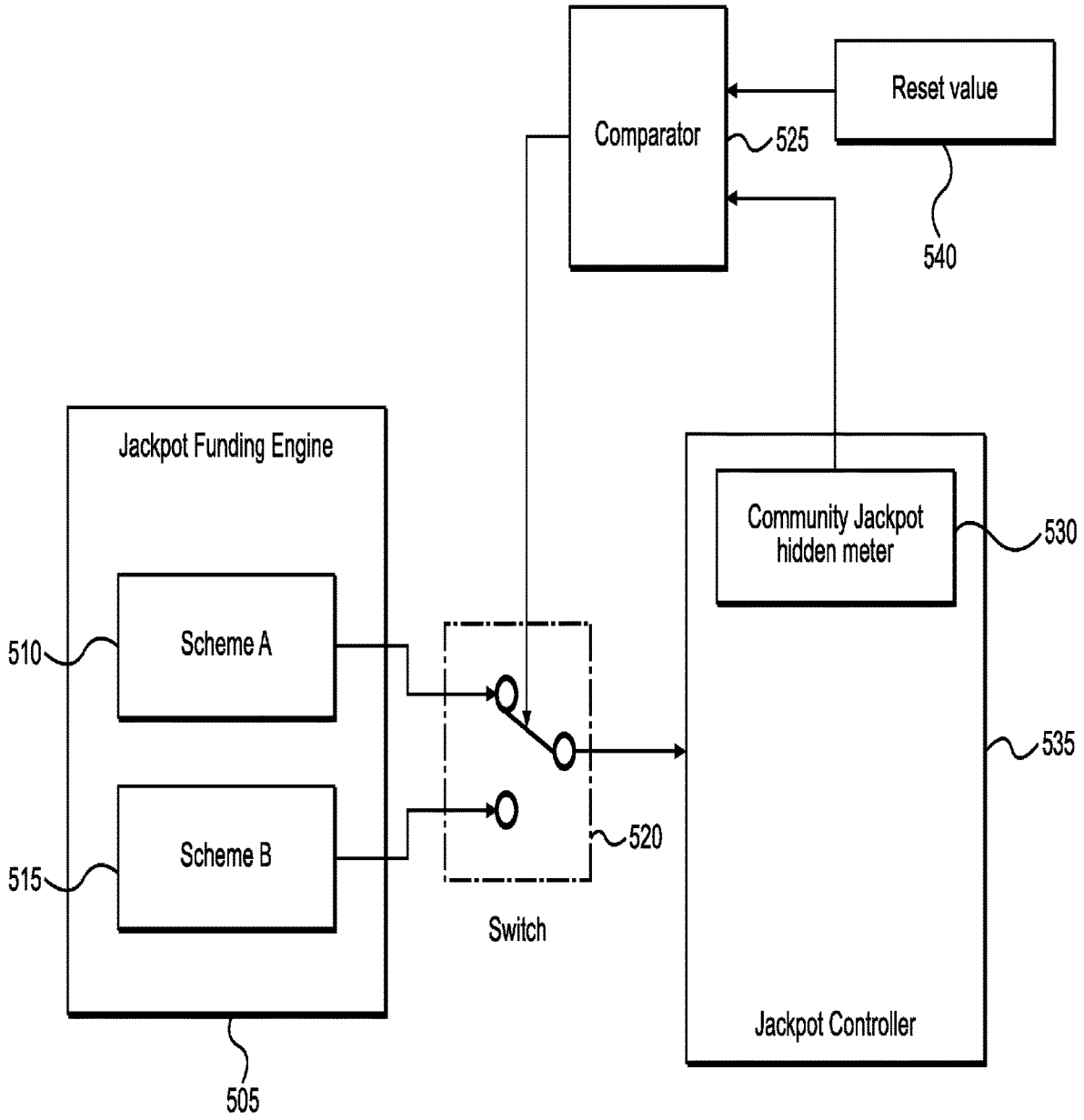
FIG. 5 is a block diagram of a hardware implementation of a jackpot funding engine.

FIG. 5 is a block diagram of a hardware implementation of a jackpot funding engine 505 with two funding schemes—Scheme A 510 and Scheme B 515. A hardware switch 520 is used to switch between Scheme A 510 and Scheme B 515. A comparator 525, connected to switch 520 senses the value of a hidden community jackpot meter 530 for a community hidden jackpot (controlled by jackpot controller 535), and a reset value 540. When comparator 525 determines that the community hidden jackpot 530 is above the base value (e.g. reset value 540) and prior to the jackpot being awarded, comparator 525 causes switch 520 to be in position for Scheme A 510. Once a community jackpot is won and until the base value is reached, comparator 525 causes switch 520 to be in position for Scheme B 515. Comparator 525 causes switch 520 to alternate between the two positions shifting funding between Scheme A 510 and Scheme B 515 over time depending on the value of the community hidden jackpot and the timing of an award of the community jackpot to winning players.

While the invention has been described with respect to the figures, it will be appreciated that many modifications and changes may be made by those skilled in the art without departing from the spirit of the invention. For example, the game may be implemented as a free play game in which it is not necessary to place a wager. It is also possible to include one or more special game wins that allows one or more of the players in the group to get a free move toward the treasure chamber. Further, a player may be awarded a special prize for removing an obstacle from the path. Any variation and derivation from the above description and drawings are included in the scope of the present invention as defined by the claims.

What is claimed is:

1. A system for facilitating a community game played cooperatively among a group of players, comprising:

(a) a plurality of electronic gaming machines (EGMs) operatively connected to a community controller and operable to simultaneously facilitate both an individual game playable by a player corresponding to a given EGM and a community game in which the player is participating as part of a group of players utilizing the plurality of EGMs, wherein each EGM includes:

(i) a display device for displaying a game play sequence of the community game, including a graphical user interface in which at least one depicted game character is moved based on directional movement outcomes obtained on the plurality of EGMs;

(ii) a random number generator (RNG) for generating random numbers, the random numbers for determining a base game outcome of an individual game being played on the EGM and a directional movement outcome for moving the at least one depicted game character of the community game;

(iii) a player input mechanism via which a player provides instructions for moving the at least one depicted game character of the community game based on the directional movement outcomes obtained via the random numbers obtained by the EGM; and (iv) at least one processor and a memory storing instructions which, when executed, cause the at least one processor to:

randomly select a first directional movement outcome for the community game, using the RNG;

control the display device to output an indication of the first directional movement outcome as being available for use in the community game;

receive a first instruction from the player to apply the first directional movement outcome in the community game;

control the display device to modify the graphical user interface by applying the first directional movement outcome and thereby moving the at least one depicted game character in accordance with the first instruction;

communicate with the community controller to provide the first instruction to the community controller for output to a remainder of the plurality of the EGMs;

receive from the community controller an indication of a second instruction, the second instruction comprising a second directional movement outcome obtained on a second EGM of the plurality of EGMs;

control the display device to modify the graphical user interface by applying the second directional movement outcome and thereby moving the at least one depicted game character in accordance with the second instruction; and continue to update information output on the display device, throughout a duration of the community game, to indicate the game play sequence of the community game based on information received from the community controller; and (b) a community controller operatively connected to each of the plurality of EGMs and operable to facilitate an application of individual directional movements achieved by the plurality of EGMs as movements of the at least one depicted game character in the community game, the community controller comprising at least one processor and instructions, which, when executed, cause the at least one processor to at least:

(i) obtain instructions from a given EGM of the plurality of EGMs, each such instruction indicating a specific directional movement outcome to be applied to the at least one depicted game character of the community game, each such instruction being based on a corresponding random number that was obtained on the EGM from which the instruction was obtained;

(ii) transmit each such instruction to all other EGMs participating in the community game;

(iii) cause a respective display of each EGM to which the instruction was transmitted to be modified by applying the specific directional movement outcome and thereby moving the at least one depicted game character in accordance with the specific directional movement outcome; and (iv) continue to coordinate play and updates to the displays of the EGMs by transmitting instructions to the EGMs based on game play developments of the community game;

wherein, a community jackpot is awarded and divided among the plurality of EGMs if a group of players at the plurality of EGMs successfully execute a sequence of predefined movements of the at least one depicted game character during the community game; and at least one additional award is available to each player of the group of players, each of the community jackpot and the at least one additional award being funded by wagers on the EGMs and each player of the group of players playing cooperatively as part of the group of players for the community jackpot and simultaneously playing individually for the at least one additional award.

2. The system of claim 1, wherein the community controller is operable to award the community jackpot by one of (i) dividing a value of the community jackpot equally among the group of players; or (ii) allocating amounts of the community jackpot relative to amounts wagered by each respective player of the group of players during the community game.

3. The system of claim 1, comprising:

a first funding scheme (B) using a first allocation of a portion of the wagers made at a given EGM of the plurality of EGMs to fund the community jackpot and the at least one additional award that is applied beginning at a first time (t1) after a prior community jackpot has been won and a second time (t2) when a base level for the community jackpot has been reached;

a second funding scheme (A) using a second allocation of a portion of the wagers to fund the community jackpot and the at least one additional wager that is applied beginning at a third time (t2) after the base level for the community jackpot has been reached and a fourth time (t3) when a community jackpot has been won; and wherein the first funding scheme is different from the second funding scheme.

4. The system of claim 3, wherein the first allocation has a greater portion of the wagers allocated to funding the community jackpot than the second allocation.

5. The system of claim 3, wherein if the community game ends between the first time (t1) and the second time (t2), a difference value ("DV") is added to the community reset value for a next cycle, and the first funding scheme (B) is maintained until a value equal to the community reset value plus DV is reached, where DV is the difference between: (a) the community reset value; and (b) a current amount of funding attributed to the community jackpot when the community game ends before the community reset value was reached.

6. The system of claim 3, wherein the funding continuously alternates between the first funding scheme (B) and the second scheme (A) as community jackpots are won over time.

7. The system of claim 1, wherein if a player at a given EGM of the plurality of EGMs fails to participate in play of the community game before the group successfully executes the sequence of predefined directional movements, the community game terminates and any remaining players from the group of players are ineligible to win the community jackpot.

8. The system of claim 1, wherein the community game is conducted as a game type from the group comprising: (a) a base game; (b) a bonus or secondary game; and (c) a sub-game.

9. The system of claim 1, wherein the at least one additional award available is of a type from the group comprising: (a) a progressive award; (b) a mystery award; (c) a fixed award; (d) a non-monetary award; (e) a free play; and (f) any other award.

10. A method for facilitating play on an electronic gaming machine (EGM) operatively connected to a community controller and operable to facilitate both an individual game played by a player of the EGM and a community game in which the player is participating, the method comprising:

controlling a display device of the EGM to display a game play sequence of the community game, the display device for outputting a graphical user interface in which at least one depicted game character is moved based on directional movement outcomes obtained on a plurality of EGMs participating in the community game;

randomly selecting a first directional movement outcome for use in the community game, using a random number generator (RNG) of the EGM, wherein the RNG is operable to generate random numbers for determining both a base game outcome of an individual game being played on the EGM and a directional movement outcome for moving the at least one depicted game character of the community game;

updating the display device of the EGM to output an indication of the first directional movement outcome as being available for use in the community game, wherein;

receiving, through a player input mechanism of the EGM, a first instruction from the player to apply the first directional movement outcome in the community game;

controlling the display device to modify the graphical user interface by applying the first directional movement outcome and thereby moving the at least one depicted game character in accordance with the first instruction;

communicating with the community controller to provide the first instruction to the community controller for output to a remainder of the plurality of EGMs participating in the community game;

receiving from the community controller an indication of a second instruction, the second instruction comprising a second directional movement outcome obtained on a second EGM of the plurality of EGMs;

controlling the display device to modify the graphical user interface by applying the second directional movement outcome and thereby moving the at least one depicted game character in accordance with the second instruction; and continuing to update information output on the display device, throughout a duration of the community game, to indicate the game play sequence of the community game based on information received from the community controller and instructions received through the player input mechanism, wherein, a community jackpot is awarded and divided among the plurality of EGMs if a group of players at the plurality of EGMs successfully execute a sequence of predefined movements of the at least one depicted game character during the community game; and (ii) at least one additional award is available to each player of the group of players, each of the community jackpot and the at least one additional award being funded by wagers on the EGMs and each player of the group of players playing cooperatively as part of the group of players for the community jackpot and simultaneously playing individually for the at least one additional award.

11. The method of claim 10, further comprising:

receiving from the community controller an instruction to award the community jackpot to the player; and controlling the display device to output an indication of the awarding of the community jackpot.

12. The method of claim 11, wherein the community controller is operable to award the community jackpot by one of (i) dividing a value of the community jackpot equally among the group of players; or (ii) allocating amounts of the community jackpot relative to amounts wagered by each respective player of the group of players during the community game.

13. The method of claim 11, comprising:

a first funding scheme (B) using a first allocation of a portion of the wagers made at a given EGM of the plurality of EGMs to fund the community jackpot and the at least one additional award that is applied beginning at a first time (t1) after a prior community jackpot has been won and a second time (t2) when a base level for the community jackpot has been reached;

a second funding scheme (A) using a second allocation of a portion of the wagers to fund the community jackpot and the at least one additional wager that is applied beginning at a third time (t2) after the base level for the community jackpot has been reached and a fourth time (t3) when a community jackpot has been won; and wherein the first funding scheme is different from the second funding scheme.

14. The method of claim 13, wherein the first allocation has a greater portion of the wagers allocated to funding the community jackpot than the second allocation.

15. The method of claim 13, wherein if the community game ends between the first time (t1) and the second time (t2), a difference value ("DV") is added to the community reset value for a next cycle, and the first funding scheme (B) is maintained until a value equal to the community reset value plus DV is reached, where DV is the difference between: (a) the community reset value; and (b) a current amount of funding attributed to the community jackpot when the community game ends before the community reset value was reached.

16. The method of claim 13, wherein the funding continuously alternates between the first funding scheme (B) and the second scheme (A) as community jackpots are won over time.

17. The method of claim 10, wherein if a player at a given EGM of the plurality of EGMs fails to participate in play of the community game before the group successfully executes the sequence of predefined directional movements, the community game terminates and any remaining players from the group of players are ineligible to win the community jackpot.

18. The method of claim 10, wherein the community game is conducted as a game type from the group comprising: (a) a base game; (b) a bonus or secondary game; and (c) a sub-game.

19. The method of claim 10, wherein the at least one additional award available is of a type from the group comprising: (a) a progressive award; (b) a mystery award; (c) a fixed award; (d) a non-monetary award; (e) a free play; and (f) any other award.

* * * * *